US010456893B2

(12) United States Patent
Westerman et al.

(10) Patent No.: US 10,456,893 B2
(45) Date of Patent: Oct. 29, 2019

(54) CLUTCH WRENCH DEVICE

(71) Applicants: Richard Westerman, Peoria, AZ (US); George Reitz, Peoria, AZ (US)

(72) Inventors: Richard Westerman, Peoria, AZ (US); George Reitz, Peoria, AZ (US)

( * ) Notice: Subject to any disclaimer, the term of this patent is extended or adjusted under 35 U.S.C. 154(b) by 155 days.

(21) Appl. No.: 15/591,098

(22) Filed: May 9, 2017

(65) Prior Publication Data

US 2017/0326709 A1 Nov. 16, 2017

Related U.S. Application Data

(60) Provisional application No. 62/334,373, filed on May 10, 2016.

(51) Int. Cl.
*B25B 13/46* (2006.01)
*B25B 13/48* (2006.01)

(52) U.S. Cl.
CPC ..... *B25B 13/462* (2013.01); *B25B 13/481* (2013.01)

(58) Field of Classification Search
CPC ..... B25B 13/462
USPC ..... 81/15.9, 59.1
See application file for complete search history.

(56) References Cited

U.S. PATENT DOCUMENTS 3,444,767 A * 5/1969 Cupler ..... B25B 13/462 81/58
4,099,430 A * 7/1978 Studola ..... B25B 13/00 81/58.1
5,765,669 A * 6/1998 Adams ..... B25B 13/462 192/43
6,044,944 A * 4/2000 Adams ..... B25B 13/462 192/43
6,253,646 B1 * 7/2001 Chang ..... B25B 13/462 192/44
6,584,874 B1 * 7/2003 Wade ..... B25B 13/462 81/60
2001/0032529 A1 * 10/2001 Barnett ..... B25B 13/461 81/59.1
2018/0079055 A1 * 3/2018 Wang ..... B25B 13/46

* cited by examiner

*Primary Examiner* — Hadi Shakeri
(74) *Attorney, Agent, or Firm* — Bruce A. Lev

(57) ABSTRACT

A clutch wrench device is a ratchet wrench that is able to grip when rotated back and forth even in minute radians so that it can be used in very tight spaces for tightening or loosening fasteners. The device uses a sprag mechanism that is able to frictionally lock the rotatable and non-rotatable parts together when rotated one direction and rotate freely when rotated the other direction.

15 Claims, 4 Drawing Sheets

CLUTCH WRENCH DEVICE

CROSS-REFERENCE TO RELATED APPLICATION

The present application is related to and claims priority from prior provisional application Ser. No. 62/334,373, filed May 10, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of hand tools and more specifically relates to a clutch wrench device.

2. Description of the Related Art

Hand tools are used in nearly every industry as well as for home use. The automotive repair industry may use the largest number and the most diverse types of tools, but with the exception of the specialty tools in automotive repair, a majority of the non-powered hand tools may be used across multiple industries. Wrenches are used for loosening and tightening fasteners that hold things together. Wrenches come in different sizes and types for use on different sizes and types of fasteners. An open end or boxed end wrench has no moving parts and when placed on the fastener, the user applies the torque to the handle to remove or tighten the fastener. These are used quite often in tight spaces but when space is not restricted, a user may prefer to use some type of speed wrench. Ratchets have been developed to be used with a plurality of different sizes of sockets for gripping the various sizes of fastener heads, which are usually hexagonal in shape. A ratchet has moving parts in the head of the ratchet where the socket connects and a pivoting action of the handle actuates the ratchet mechanism either in a clockwise or a counter clockwise direction depending on where the directional rotation lever is set. The handle rotates freely one direction and applies torque the other direction.

Ratchets can be useful in locations having restricted space since only a back and forth motion is required and the use of one will most likely greatly reduce the amount of time spent turning fasteners. The drawback to a ratchet is that the radian of the handle swing motion is often too long in order to catch the next tooth in the ratchet mechanism making the handle swing radian too long to be useful in very tight spaces. Even fine toothed ratcheting mechanisms often have too long of a handle swing arc to be useful. A solution is needed.

Various attempts have been made to solve the above-mentioned problems such as those found in U.S. Pat. No. 6,584,874 to Michael O. Wade; U.S. Pat. No. 4,099,430 to Roger D. Studola; U.S. Pat. No. 3,444,767 to Cupler Melvin C; and U.S. Pat. No. 5,765,669 to Daniel T. Adams. This art is representative of ratcheting wrenches. None of the above inventions and patents, taken either singly or in combination, is seen to describe the invention as claimed.

Ideally, a hand tool should provide ease of use in tight spaces, and yet, would operate reliably and be manufactured at a modest expense. Thus, a need exists for a reliable clutch wrench device to avoid the above-mentioned problems.

BRIEF SUMMARY OF THE INVENTION

In view of the foregoing disadvantages inherent in the known hand tool art, the present invention provides a novel clutch wrench device. The general purpose of the present invention, which will be described subsequently in greater detail, is to provide ease of use in tight spaces.

The clutch wrench device preferably comprises an elongated body including an elongated center portion, a handle portion located on a proximal end of the body, and a head portion located on the distal end of the body comprising a head encasement formed having a round central opening therethrough, and a race member formed having a ring-shape with an interior surface and an outer surface and is adapted to fit within the round central opening. The outer surface of the race member is adapted to include a keyway for holding a key. An engagement member is included having an outer circumference with a circular shape that is adapted to engage with and rotate within a sprag member. The engagement member has an inner circumference having a polygonal shape adapted to releasably connect with a polygonal head of a bolt member. A sprag member is formed having a ring-shape and is adapted to fit and rotate within, and to lock in relation to the race member. The sprag member includes a plurality of spaced sprags adapted to pivot and to lock against of the interior surface of the race member and against the outer circumference of the engagement member such that the sprag member is adapted to frictionally grip to the race member when rotated in one direction and move freely when turned in an opposing direction. A key is adapted to have a rectangular shape to fit within the keyway of the outer surface of the race member and align with and fit within a notch in the inner surface of the central opening of the head encasement to lock and prevent rotation of the race member in relation to the head encasement. The inner circumference of the engagement member is formed with a polygonal shape adapted to releasably connect with the polygonal shaped head of a bolt member.

A spring clip member having a C-shape is adapted to fit between the head encasement and the race member and contact the inner surface of the head encasement around the round central opening and the outer surface of the race member to thereby releasably retain the head encasement and the race member within the head encasement. Opposite ends of the C-Shape of the spring clip member each include an aperture therethrough adapted to allow the spring clip member to be deformed and placed within or removed from the head encasement.

A retention disk having a ring-shape is adapted to be placed between the spring clip member and the race member and sprag member to thereby hold the spring clip member and the race member within the head encasement. A first spacer member having a ring-shape is adapted to be placed between the retention disk and the engagement member to thereby hold the engagement member within the head encasement. A second spacer member having a ring-shape is adapted to be placed between the engagement member and the inner back wall of the head encasement to thereby further hold the engagement member within the head encasement.

The polygonal shape of the engagement member may be formed as a hexagon but can be shaped as an octagon. The handle portion is adapted to be rotated in a clockwise or counterclockwise direction relative to the engagement member in adjustments of minute radians. The teeth releasably engage the spaced sprags via frictional wedging.

The central opening of the head encasement is formed having a first diameter on the front face of the head encasement, and a second diameter on a back face of the head encasement with the first diameter being larger than the second diameter. The head encasement is preferably formed from a corrosion resistant material which may be 4140 tool steel or may be made of a material having a corrosion resistance and tensil strength equivalent or greater than 4140 tool steel. The elongated center portion and the handle portion may be formed from a high strength composite material. The composite material may be formed from the group of materials consisting of 4140 tool steel, polyester, and fiberglass.

The present invention holds significant improvements and serves as a clutch wrench device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, clutch wrench device, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a hand tool and more particularly to a clutch wrench device as used to improve the ease of use in tight spaces.

Generally speaking, a clutch wrench device is a ratchet wrench that is able to grip when rotated back and forth even in minute radians so that it can be used in very tight spaces for tightening or loosening fasteners. The device uses a sprag mechanism that is able to frictionally lock the rotatable and non-rotatable parts together when rotated one direction and rotate freely when rotated the other direction.

Figure 1:
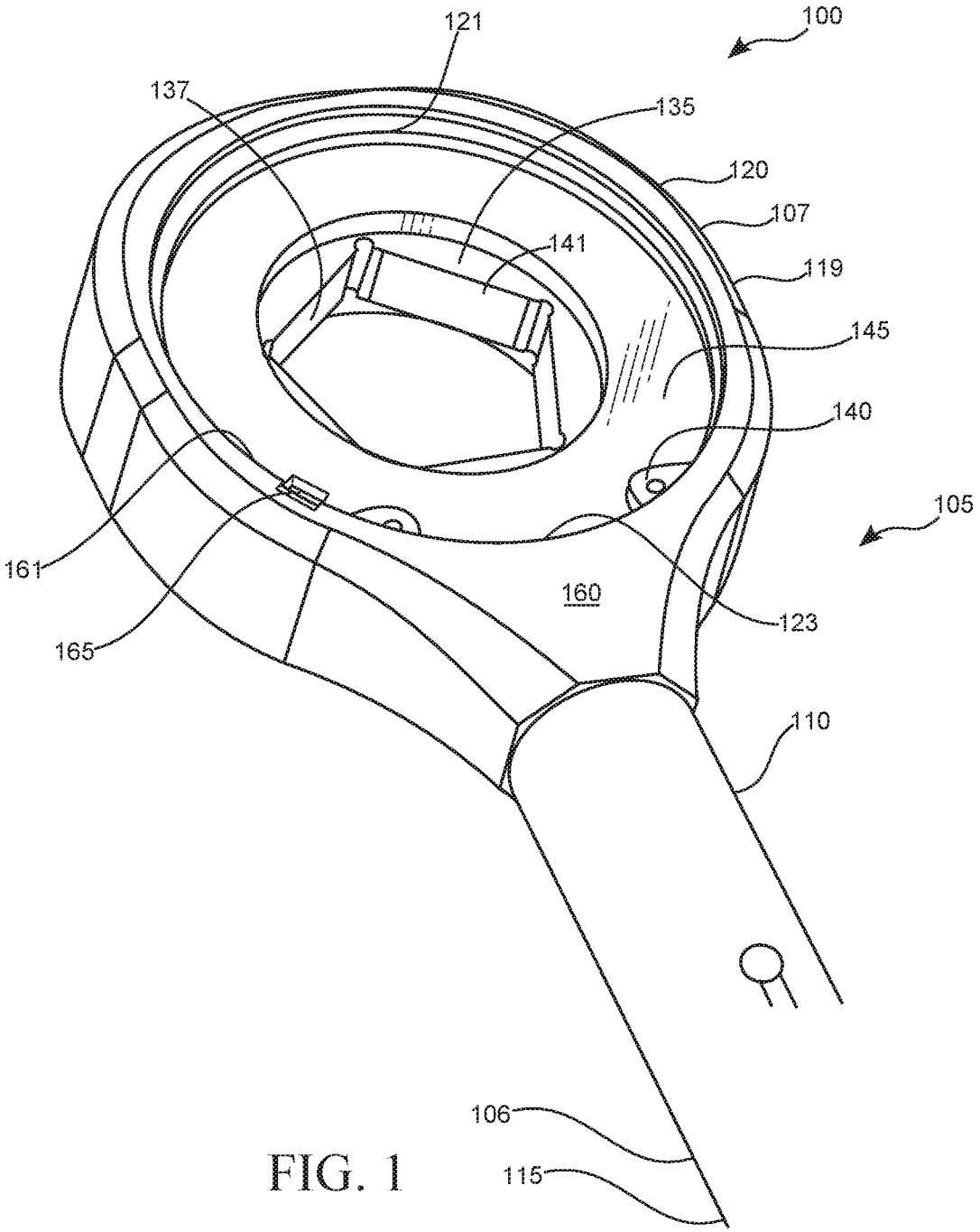
FIG. 1 shows a perspective view illustrating a clutch wrench device according to an embodiment of the present invention.

In greater detail now, referring to the drawings by numerals of reference there is shown in FIG. 1, a perspective view illustrating clutch wrench device 100 according to an embodiment of the present invention.

Clutch wrench device 100 preferably comprises elongated body 105 including elongated center portion 110, handle portion 115 located on proximal end 106 of elongated body 105, and head portion 119 located on distal end 107 of elongated body 105 comprising head encasement 120 formed having a round central opening 123 therethrough, and race member 125 formed having a ring-shape with interior surface 126 and outer surface 128 and is adapted to fit within round central opening 123. Outer surface 128 of race member 125 is adapted to include key way 165 for holding key 166. Engagement member 135 is included having outer circumference 136 with a circular shape that is adapted to engage with and rotate within sprag member 130. Engagement member 135 has inner circumference 137 having a polygonal shape adapted to releasably connect with a polygonal head of a bolt member. Inner circumference 137 may be octagonally shaped or may be adapted to have any fastener head shape either imperial or metric. Sprag member 130 is formed having a ring-shape and is adapted to fit and rotate within, and to lock in relation to race member 125. Sprag member 130 includes a plurality of spaced sprags 127 adapted to pivot and to lock against interior surface 126 of race member 125 and against outer circumference 136 of engagement member 135 such that sprag member 130 is adapted to frictionally grip to race member 125 when rotated in one direction and move freely when turned in an opposing direction. Key 166 is adapted to have a rectangular shape to fit within key way 165 of outer surface 128 of race member 125 and align with and fit within notch 170 in inner surface 121 of central opening 123 of head encasement 120 to lock and prevent rotation of race member 125 in relation to head encasement 120. Inner circumference 137 of engagement member 135 is formed having a polygonal shape adapted to releasably connect with the polygonal shaped head of a bolt member. Inner circumference 137 may be adapted to fit any size or shape of fastener head.

Figure 2:
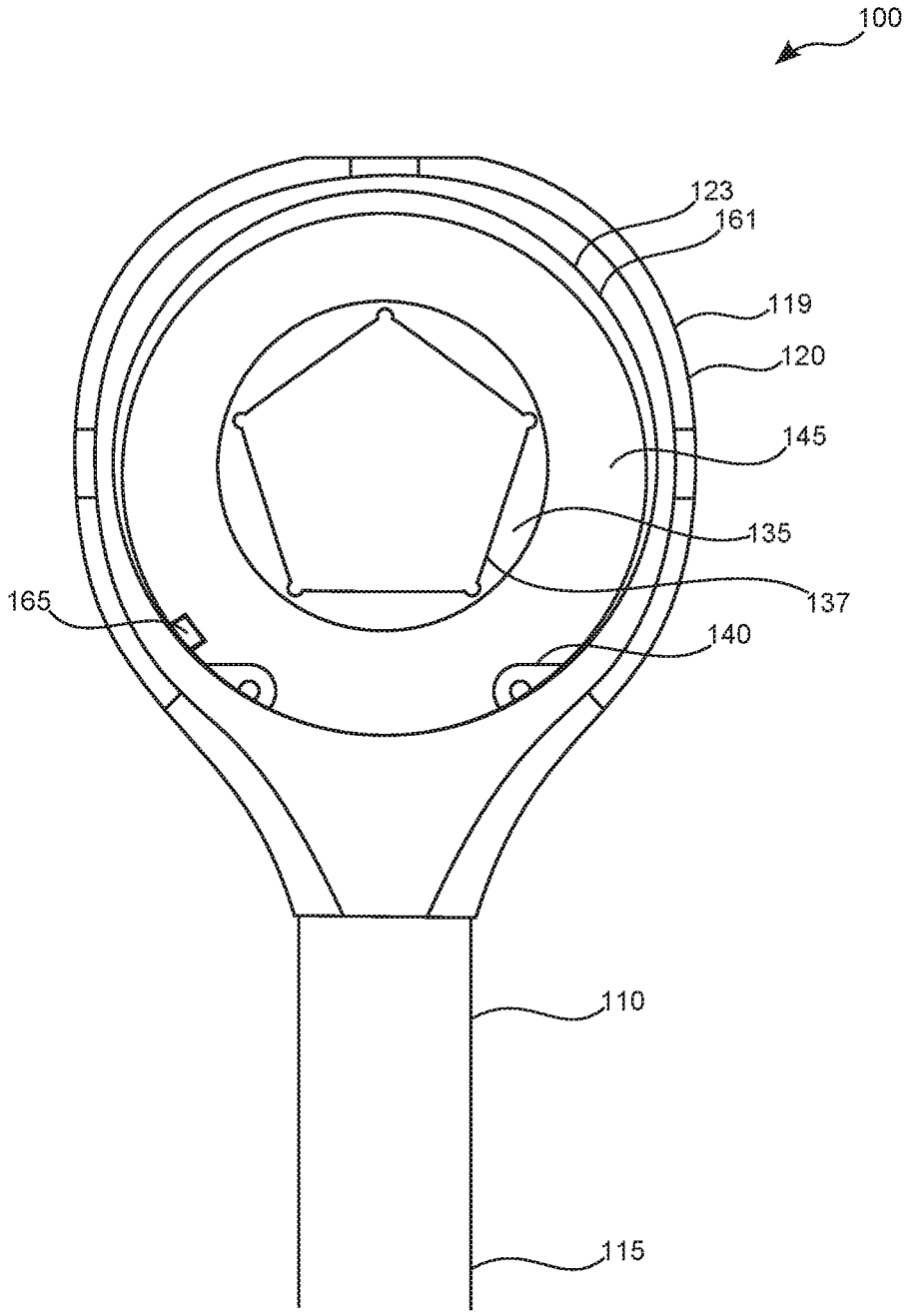
FIG. 2 is a front view illustrating the clutch wrench device according to an embodiment of the present invention of FIG. 1.

Referring now to FIG. 2, a front view illustrating clutch wrench device 100 according to an embodiment of the present invention of FIG. 1.

The polygonal shape of engagement member 135 may be formed as a hexagon but can be shaped as an octagon or any fastener shape including imperial or metric sizes. Handle portion 115 is adapted to be rotated in a clockwise or counterclockwise direction relative to the engagement member in adjustments of minute radians. Teeth 132 releasably engage the spaced sprags 127 via frictional wedging.

Central opening 123 of head encasement 120 is formed having first diameter 161 on front face 160 of head encasement 120, and second diameter 163 on back face 162 of head encasement 120 with first diameter 161 being larger than second diameter 163.

Figure 3:
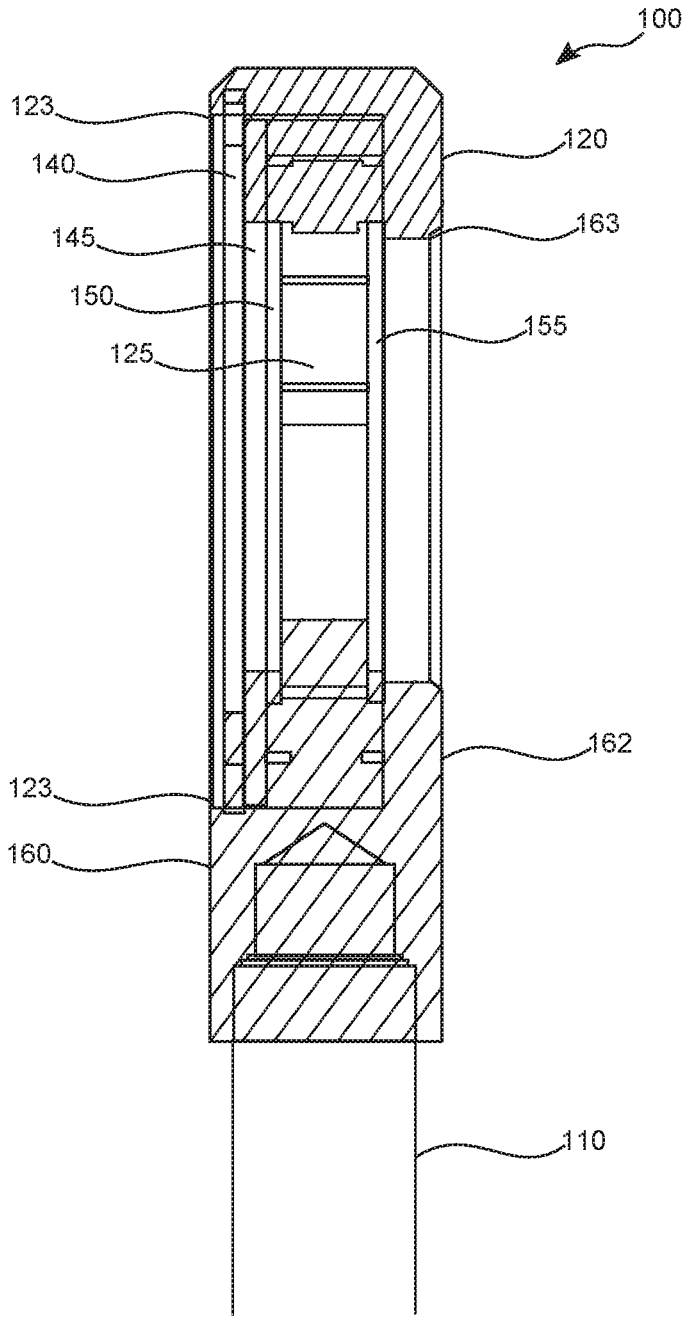
FIG. 3 is a side view illustrating clutch wrench device according to an embodiment of the present invention of FIG. 1.

Referring now to FIG. 3, is a side view illustrating clutch wrench device 100 according to an embodiment of the present invention of FIG. 1.

Head encasement 120 is preferably formed from a corrosion resistant material which may be 4140 tool steel or may be made of a material having a corrosion resistance and tensil strength equivalent or greater than 4140 tool steel. Elongated center portion 110 and handle portion 115 may be formed from a high strength composite material. The composite material may be formed from the group of materials consisting of 4140 tool steel, polyester, and fiberglass.

Figure 4:
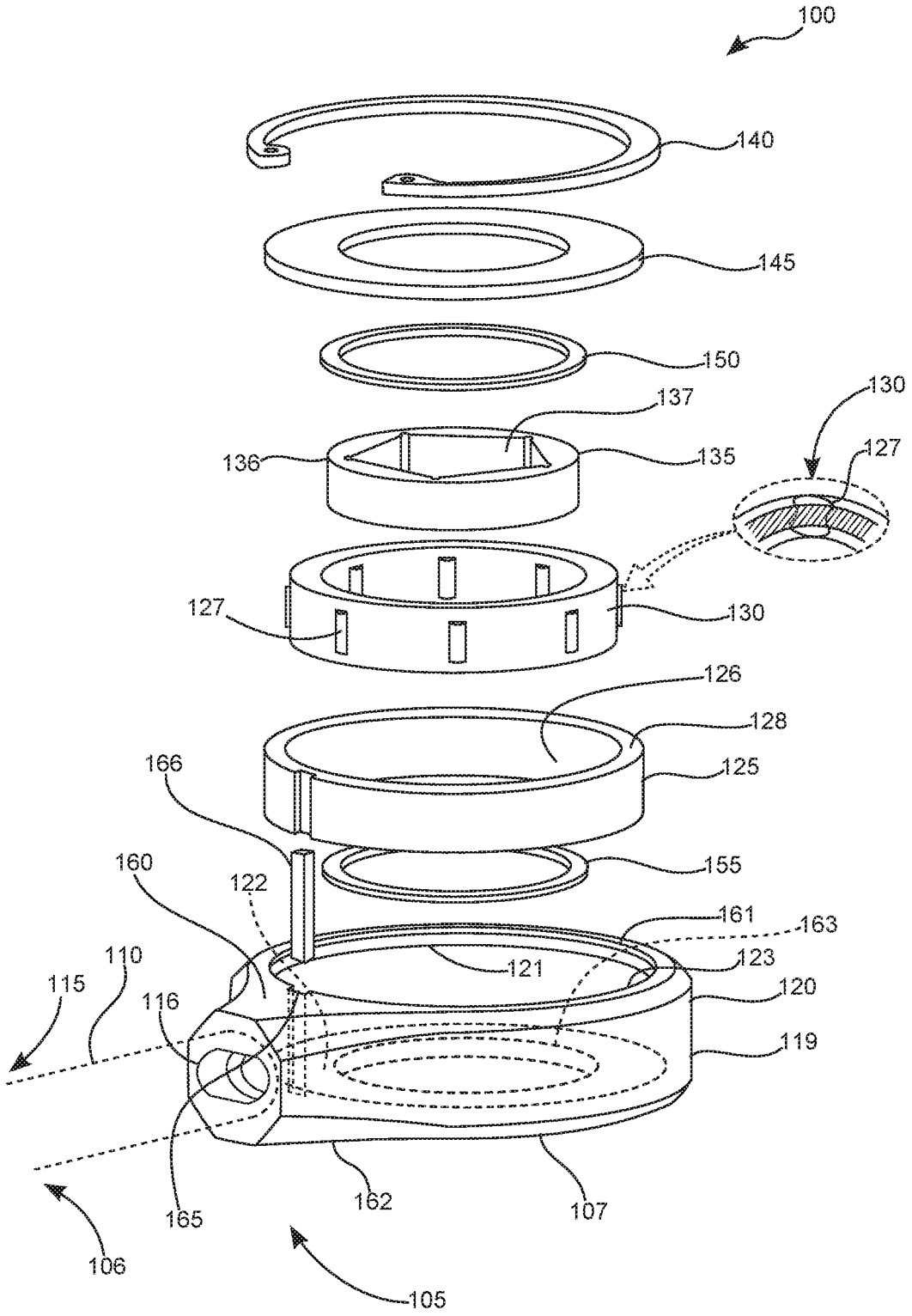
FIG. 4 is an exploded view illustrating clutch wrench device according to an embodiment of the present invention of FIG. 1.

Referring now to FIG. 4, is an exploded view illustrating clutch wrench device 100 according to an embodiment of the present invention of FIG. 1.

Spring clip member 140 having a C-shape is adapted to fit between head encasement 120 and race member 125 and contact inner surface 121 of head encasement 120 around the round central opening 123 and outer surface 128 of race member 125 to thereby releasably retain head encasement 120 and race member 125 within head encasement 120. Opposite ends of the C-Shape of spring clip member 140 each include aperture 141 therethrough adapted to allow spring clip member 140 to be deformed and placed within or removed from head encasement 120. Retention disk 145 having a ring-shape is adapted to be placed between spring clip member 140 and race member 125 and sprag member 130 to thereby hold spring clip member 140 and race member 125 within head encasement 120.

First spacer member 150 having a ring-shape is adapted to be placed between retention disk 145 and engagement member 135 to thereby hold engagement member 135 within head encasement 120. Second spacer member 155 having a ring-shape is adapted to be placed between engagement member 135 and inner back wall 122 of head encasement 120 to thereby further hold engagement member 135 within head encasement 120.

Clutch wrench device 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., kit contents or arrangements such as, for example, including more or less tools in combination with clutch wrench device, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A clutch wrench device comprising:

an elongated body including:

an elongated center portion;

a handle portion;

wherein said handle portion at located on a proximal end of said body; and a head portion located on a distal end of said body, comprising:

a head encasement;

wherein said head encasement is formed having a round central opening therethrough; and wherein said head encasement is formed having a notch within an inner surface forming said central opening;

a race member;

wherein said race member is formed having a ring-shape having an interior surface and an outer surface and is adapted to fit within said round central opening;

wherein said outer surface of said race member is adapted to include a keyway for holding a key;

an engagement member including:

an outer circumference having a circular shape and adapted to engage with and rotate with a sprag member;

an inner circumference having a polygonal shape adapted to releasably connect with a polygonal head of a bolt member;

a sprag member;

wherein said sprag member is formed having a ring-shape and is adapted to fit and rotate within said race member; and wherein said sprag member includes a plurality of spaced sprags adapted to pivot and to lock against of said interior surface of said race member and against said outer circumference of said engagement member, such that said sprag member is adapted to frictionally grip to said race member when rotated in one direction, and move freely when turned in an opposing direction; and a key;

wherein said key is adapted to have a rectangular shape to fit within said keyway of said outer surface of said race member and align with and fit within said notch in said inner surface of said central opening of said head encasement to lock and prevent rotation of said race member in relation to said head encasement.

2. The clutch wrench device of claim 1, further comprising a spring clip member having a C-shape and is adapted to fit between said head encasement and said race member and contact an inner surface of said head encasement around said round central opening and an outer surface of said race member to thereby releasably retain said head encasement and said race member within said head encasement.

3. The clutch wrench device of claim 2, wherein opposite ends of said C-Shape of said spring clip member each includes an aperture therethrough adapted to allow said spring clip member to be deformed and placed within said head encasement and deformed and removed from said head encasement.

4. The clutch wrench device of claim 3, further comprising a retention disk having a ring-shape and is adapted to be placed between said spring clip member and said race member and said sprag member to thereby hold said spring clip member and said race member within said head encasement.

5. The clutch wrench device of claim 4, further comprising a first spacer member having a ring-shape and is adapted to be placed between said retention disk and said engagement member to thereby hold said engagement member within said head encasement.

6. The clutch wrench device of claim 5, further comprising a second spacer member having a ring-shape and is adapted to be placed between said engagement member and an inner back wall of said head encasement to thereby further hold said engagement member within said head encasement.

7. The clutch wrench device of claim 1, wherein said polygonal shape of said engagement member is formed as a hexagon.

8. The clutch wrench device of claim 1, wherein said polygonal shape of said engagement member is formed as an octagon.

9. The clutch wrench device of claim 1, wherein said handle portion is adapted to be rotated in a clockwise or counterclockwise direction relative to the engagement member in adjustments of minute radians.

10. The clutch wrench device of claim 1, wherein said plurality of spaced spags are adapted to have a FIG. 8 crosssection such that when pivoted, said plurality of spaced spags releasably engage with said interior surface of said race member and said outer circumference of said engagement member via frictional wedging.

11. The clutch wrench device of claim 1, wherein said central opening of said head encasement is formed having a first diameter on a front face of said head encasement, and a second diameter on a back face of said head encasement; and wherein said first diameter is larger than said second diameter.

12. The clutch wrench device of claim 1, wherein said head encasement is formed from a corrosion resistant material.

13. The clutch wrench device of claim 12, wherein said corrosion resistant material is 4140 tool steel.

14. The clutch wrench device of claim 12, wherein said elongated center portion and said handle portion are formed from a composite material.

15. The clutch wrench device of claim 14, wherein said composite material is formed from a group of materials consisting of 4140 tool steel, polyester, and fiberglass.

* * * * *